United States Patent [19]

Schierenbeck

[11] Patent Number: 4,850,057

[45] Date of Patent: Jul. 25, 1989

[54] FIRE FIGHTERS' BUNKER PANTS SUSPENDERS

[76] Inventor: Alan W. Schierenbeck, P.O. Box 1286, 306 Middle St., Fairborn, Ohio 45324

[21] Appl. No.: 228,261

[22] Filed: Aug. 4, 1988

[51] Int. Cl.[4] ..... C21H 2/09

[52] U.S. Cl. ..... 2/328; 2/325

[58] Field of Search ..... 2/326, 327, 328, 329, 2/330–331, 333, 334

[56] References Cited

U.S. PATENT DOCUMENTS

| | | | |
|---|---|---|---|
| 140,652 | 7/1873 | Shenfield | 2/331 |
| 190,516 | 5/1877 | Richmond | 2/326 |
| 277,776 | 5/1883 | Petdraft | 2/334 |
| 290,958 | 12/1883 | Atwood | 2/326 |
| 359,366 | 3/1887 | Sisson | 2/326 |
| 715,931 | 12/1902 | Adams | 2/334 |
| 892,446 | 7/1908 | Payne | 2/327 |
| 1,077,571 | 11/1913 | Weber | 2/327 |
| 1,274,582 | 8/1918 | Olson | 2/327 |
| 1,450,303 | 4/1923 | Potter | 2/327 |
| 2,185,400 | 1/1940 | Cohen | 2/334 |
| 2,777,134 | 1/1957 | Kaufman | 2/328 |

FOREIGN PATENT DOCUMENTS

| | | | |
|---|---|---|---|
| 750069 | 8/1933 | France | 2/326 |
| 366428 | 12/1938 | Italy | 2/328 |
| 211482 | 9/1940 | Switzerland | 2/326 |

*Primary Examiner*—Werner H. Schroeder
*Assistant Examiner*—Jeanette E. Chapman
*Attorney, Agent, or Firm*—Porter, Wright, Morris & Arthur

[57] ABSTRACT

Adjustable firefighters' suspenders are described. The suspenders, which are designed for comfort and flexibility during normal fire fighting or other rigorous activities, are constructed of high quality, durable materials with a long life-expectancy and include a back pivot point adjustment and flex straps at the ends of leather straps. The suspenders eliminate the need for waist adjustment straps or belts to aid in the support of the bunker pants.

5 Claims, 1 Drawing Sheet

FIRE FIGHTERS' BUNKER PANTS SUSPENDERS

FIELD OF THE INVENTION

This invention relates to suspenders to be worn by fire fighters with firefighters' bunker pants or by other individuals with heavy duty work requirements.

BACKGROUND OF THE ART

Firefighters' suspenders are a well known product. In the prior art, suspenders typically have been made of an elastic material. Disadvantages of prior art firefighter's suspenders include the following: the lack of the ability to be fully adjustable to fit a variety of different sized persons; the lack of resistance to high temperature (flammability); the short life-expectancy of certain elastic materials that are used to make typical suspenders; the lack of the ability to withstand rigorous activities (such as in the performance of fire fighting activities); the lack of the ability to support heavily loaded or water-soaked pants without the aid of a belt or waist adjustment strap; and poor fit which causes the suspenders to slide off of the wearer's shoulders; and the frequent occurrence of crotch rip-out because of the lack of proper fit and support.

OBJECTS OF THE INVENTION

It is an object of the invention to provide an infinitely adjustable and better fitting, longer lasting, more durable pair of suspenders which are constructed of heat resistant, high quality materials designed for comfort and flexibility during normal fire fighting or other rigorous activities.

DESCRIPTION OF THE PREFERRED EMBODIMENT

Figure 1:
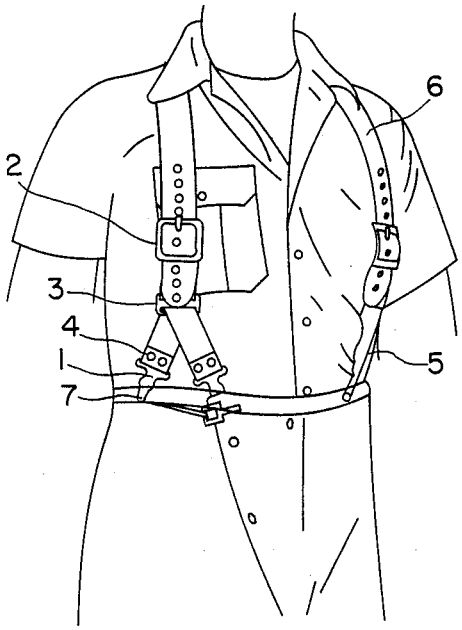
FIG. 1 is a front view of the suspenders as worn by a person.
Figure 2:
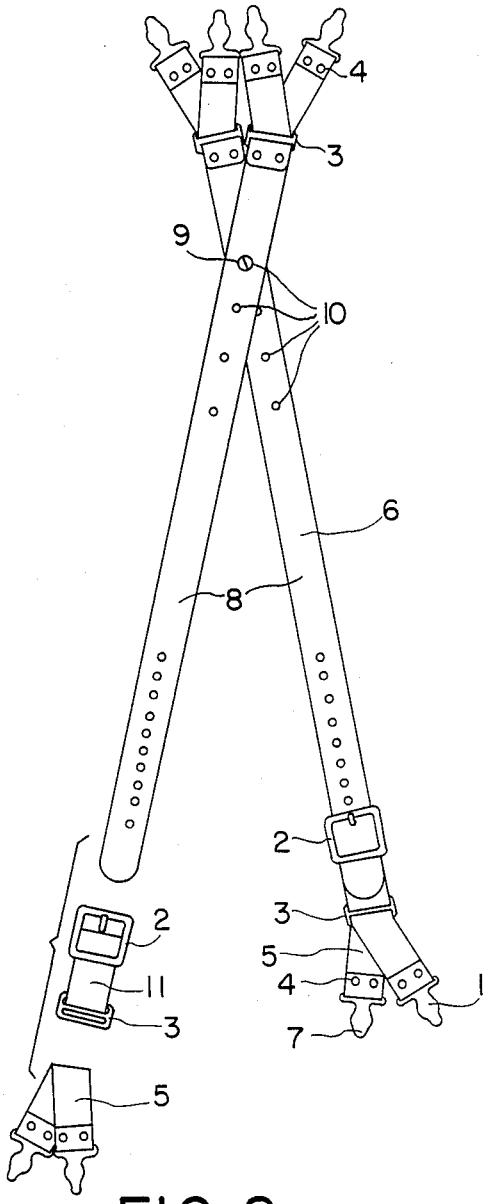
FIG. 2 is a plan view of the suspenders.
Figure 3:
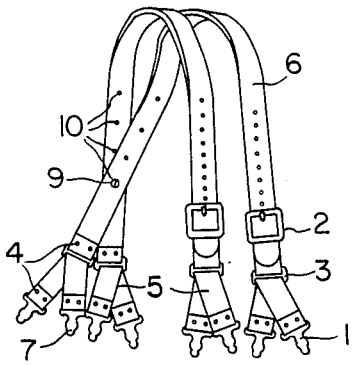
FIG. 3 is a perspective view, showing the suspenders as if draped across the shoulders of a person and attached by the loop-fasteners to the buttons of the pants.

The suspenders of the invention are designed to be infinitely adjustable in the front and rear to fit all body types. The suspenders are durable with a long life-expectancy due to the use of welded wire button loop-fasteners, 1, triple nickel plated garrison-style buckles, 2, forged alloy double-loop connectors, 3, steel rivets, 4, a neoprene rubber material which composes the "flex straps", 5, and joined split grained leather two piece straps, 6 and 11, which are dyed and permanently seal coated. The dye color may be a brilliant color such as red or yellow for increased visibility.

The welded wire button loop-fasteners, 1, are conventionally adjusted by carefully applying pressure at the junction of the attachment nipple, 7, with a pair of pliers.

The triple nickel plated garrison-style buckles, 2, provide necessary length adjustment and end the slippage which is typical of adjustment fasteners of the prior art. The garrison-style buckles are composed of a material such as a metal alloy, such as a brass or zinc alloy, or an equivalent composite alloy which is rust resistant, a useful quality for surfaces which will be exposed frequently to water.

Forged alloy double-loop connectors, 3, are used in the assembly of the suspenders of the invention for durability and long life-expectancy. These connectors are also rust-resistant.

The suspenders of the invention are assembled using rust-resistant plated steel rivets, 4, for durability. The use of steel rivets eliminates the problem of thread and seam breakage which is common in the elastic materials used in the prior art.

Free-floating "flex straps", 5, are located at all four ends of the suspenders of the invention and provide continuous shape retention and flexibility during all ranges of body motion. The "flex staps" are made of an aerospace synthetic rubber material such as an elastomeric neoprene polymer which has rebound characteristics that eliminate elastic failures of the type encountered in typically used elastic materials of the prior art. The rubber material is resistant to high temperatures (flame resistant) and has the characteristic of being self-extinguishing with respect to fire. The neoprene material of the flex straps is oil resistant and is able to withstand short duration, direct flame contact without damage to the material. The material meets or exceeds the flammability requirements of NFPA and OSHA for protective clothing. Representative specifications for the suitable neoprene material are in Table I. These qualities of this element of the suspenders are not considered to be qualities of the suspender prior art.

TABLE I

| Test - Unit of measure | Requirements |
|---|---|
| Orig. Durometer | 50 ± 5 |
| Orig. Tensile | 1450 |
| Orig. Elongation % | 350% |
| 70 Hrs. @ 212° F. Heat Aged (ASTM D573) | |
| Durometer Change | +15 Max. |
| Tensile Change | −15% Max. |
| Elongation Change | −40% Max. |
| 22 Hrs. @ 212° F. Heat Aged (ASTM D395) | |
| Compression Set | 35% Max. |
| 50 PPHM for 70 Hrs. (ASTM D1171) | |
| Ozone Resistance | No Cracks |
| Low Temperature - 40° C. (ASTM D2137) | |
| Brittleness Test | No Cracks |

The two main straps, 8, of the suspenders of the invention are attached to each other by a brass two-piece screw assembly, 9, where they cross at the rear of the suspenders. The use of the screw assembly provides not only a permanent attachment of the two straps to eliminate shoulder slippage, but also allows for multiple pivot height adjustment. This adjustment is accomplished by placing the screw assembly into one of the sets, 10, of the holes placed at various intervals on the suspender straps to provide maximum comfort and fit for the wearer. This adjustability feature is an improvement over the prior art. The suspenders will be provided in regular, long and extra long sizes each of which is adjustable in accordance with the configuration herein.

Each component of the invention is designed and used to give maximum performance and durability and to provide resistance to high temperatures and abrasion. The invention provides firefighters' suspenders formed from two long split-grained leather straps, or other equivalent material such as a web, attached to each other by a brass two-piece screw assembly at the point where the straps cross at the rear of the suspenders. Two short split-grained leather straps, 11, on the front-side of the suspenders are attached to the two long straps, 6, of the suspenders by garrison-style buckles, 2, composed of durable and rust resistant material and to durable and rust resistant double-loop connectors, 3, by means of fasteners such as rivets, which may be a rust resistant steel or metal. Four synthetic rubber "flex straps", 5, (one at the end of each of the straps of the suspenders) are looped through the four forged alloy connectors and welded wire button loop-fasteners are attached by means of steel rivets at the ends of each of the four flex-straps.

The leather straps of the suspenders are adjustable in the front and rear, respectively, at the buckle attachment and at the screw assembly. Multiple pivot height adjustment can be effected depending on the position of the buckle and screw with respect to the predetermined holes included in the straps. The straps may be dyed and permanently sealed in a brilliant color for increased visibility. In this regard the sides of the straps are subject to abrasive exposure to other garments and Preferably should not be dyed so that bleeding does not occur.

The flex straps of the suspenders provide continuous shape retention and flexibility during rigorous body motion in addition to providing useful qualities whereby the straps are flame resistant and self-extinguishing. The straps withstand short duration, direct flame contact without damage to the material and meet or exceed flammability requirements of NFPA and OSHA for protective clothing.

The suspenders of the invention provide the flexibility to perform normal fire fighting or other rigorous movements comfortably. The durability and the functioning performance characteristics of the suspenders of the invention eliminate the need for additional waist adjustment straps or belts to aid n the support of the bunker pants. Without the use of the waist adjustment straps or a belt, the wearer has the added comfort of improved air circulation and ventilation around the waist area during normal fire fighting or other rigorous activities. The performance of the product allows the user to wear looser fitting protective trousers increasing the protective insulative dead air space between the garment and the wearer's body. In addition, the wearer's mobility is enhanced. The durability of the suspenders also eliminates sagging pants which are a result of the inferior elastic materials used in typical elastic suspenders. In the prior art, sagging pants often cause undue stress on the crotch seams of bunker pants, resulting in "crotch rip-out." The improvements of the invention eliminate this problem and the discomfort, inconvenience and expense associated with it.

In addition, by maintaining a proper fit, mobility in action is increased. The insulative dead air space between pants and a firefighter's body may be increased because the firefighter can wear looser protective clothing due to the increased performance and reliability of the suspenders.

In its preferred embodiment, overall specifications for the suspenders require that each component shall provide resistance to high temperatures and abrasion and that in and of themselves, the suspenders should support a heavily loaded or soaked bunker pant without relying on adjustments or take-up straps at the pant waist, while providing enough flexibility to perform normal fire fighting movements comfortably.

The main body straps of a specific example of the suspenders is @8 oz. tanned grain cowhide leather with a width of 1.75". Leather is preferred because of its durability and because it is relatively inelastic when compared to the properties of the flex straps. The leather is permanently dyed and seal coated. The length adjustment is provided by a garrison style square buckle with an 1.75" interior width to accomodate the straps. The buckle is made of a durable material such as a brass or zinc alloy having a rust resistant, highly polished, nickel plated finish. The upper main leather body tips have size #3 holes spaced 0.75" apart for accurate take-up adjustment.

The double-loop connectors are formed from a forged alloy with an 1.75" interior dimension and a rust resistant, silver-tone plated finish. The suspender wire loops are welded at the top, with a flat black finish and have an 1.5" attachment opening. The flex-straps are permanently flame resistant, self extinguishing, oil resistant and able to withstand short duration direct flame contact without damage and are formed from a 0.125" thick and 1.5" wide synthetic rubber such as neoprene having the properties shown in Table I with an adequate length to allow freedom of movement.

These components are assembled with 28 rust resistant plated steel rivets with a 0.375" head and secured with similar Plated steel rivet caps. Where the two main straps cross at the rear, there are four holes placed 2" apart vertically. A large 7/16" head brass two-piece screw assembly joins the straps. The screw provides for a permanent attachment and allows for pivot height adjustment providing maximum comfort and fit. Typically, suspenders are provided in "Regular" (44" length), "Long" (50" length) and "Extra Long" (56" length) sizes.

When new, the suspenders will be fairly stiff, as are most leather products. Pre-conditioning enhances comfort during the break-in period. Each of the straps are pre-conditioned by gradually folding them over and working them back and forth, much like "breaking the back" of a playing card. First the raw leather faces the raw leather and then the dyed sides are face-to-face. These steps are repeated a few times until the leather begins to soften.

If the welded wire loops are too loose for suspender button posts, the loops are adjusted with a pair of pliers at the junction of the "attachment nipple".

The garrison style buckles on the leather straps allow "no-slip" size adjustment. Each side is tightened an equal number of holes until the crotch of the bunker pants feels comfortable, but not too snug. Squatting and high leg lift motions should be attempted in the sizing process. Once adjusted properly, bunker pants can be worn without the aid of waist adjustment straps or a belt, thus improving air circulation and ventilation which increases comfort during fire fighting activities. In most cases, after proper adjustment, the tongues of the shoulder straps will extend too far through the buckles to be useful and the excess leather may be trimmed.

In the foregoing, the preferred embodiment is described, however, many of the materials may evidently be replaced by other materials of equivalent durability and specifications, and it is not intended to exclude such equivalent elements from the scope of the invention claimed.

What is claimed is:

1. Firefighters' suspenders consisting of:

two long straps of determinate length arranged in a crossing relationship at intermediate sections of different lengths thereof towards the ends of each, said straps being attached to each other at a point by a connecting means passing through holes in the respective straps where the straps cross, said straps having at the end section thereof nearest a point of crossing double loop connectors attached to the straps;

two relatively shorter straps attached by means of garrison-style buckles to the ends of the two long straps that do not have double loop connectors, said shorter straps having at the opposite ends thereof double-loop connectors attached to the straps;

flex straps formed from an elastomeric polymer, attached at the ends of each of the short straps as they are joined by the buckle to the long straps, said flex straps being looped through the double loop connectors; and wire button loop-fasteners attached to the ends of each of the flex-straps at the ends of the longer and shorter straps.

2. The suspenders of claim 1 including a plurality of holes in the long straps in areas of the intermediate and end sections of the two longer straps which permit adjustments in the front by the garrison buckle and in the rear at the screw assembly.

3. The suspenders of claim 1 in which the straps are dyed in a brilliant color and permanently sealed.

4. The suspenders of claim 1 having double loop-fasteners which allows for adjustability of the short straps of the suspenders.

5. The suspenders of claim 1 in which the connecting means for the longer straps allows for permanent attachment of the straps at the point of crossing and permits a multiple pivot height adjustment.

* * * * *